US008845278B2

(12) United States Patent
Higashimori et al.

(10) Patent No.: US 8,845,278 B2
(45) Date of Patent: Sep. 30, 2014

(54) RADIAL TURBINE

(75) Inventors: Hirotaka Higashimori, Nagasaki (JP); Masayuki Kawami, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/814,843

(22) PCT Filed: Jan. 18, 2012

(86) PCT No.: PCT/JP2012/050945
§ 371 (c)(1),
(2), (4) Date: Feb. 7, 2013

(87) PCT Pub. No.: WO2012/102145
PCT Pub. Date: Aug. 2, 2012

(65) Prior Publication Data

US 2013/0136590 A1 May 30, 2013

(30) Foreign Application Priority Data

Jan. 27, 2011 (JP) ..... 2011-015584

(51) Int. Cl.

| | |
|---|---|
| ***F01D 5/04*** | (2006.01) |
| ***F01D 5/14*** | (2006.01) |
| ***F01D 1/08*** | (2006.01) |
| ***F01D 1/06*** | (2006.01) |
| ***F01D 9/02*** | (2006.01) |

(52) U.S. Cl.

CPC *F01D 1/06* (2013.01); *F01D 5/043* (2013.01); *F05D 2210/43* (2013.01); *F01D 9/026* (2013.01); *F05D 2250/51* (2013.01); *F01D 1/08* (2013.01); *F01D 5/04* (2013.01)

USPC ..... 415/157; 415/184; 415/206; 415/224.5; 416/185; 416/186 R; 416/231 R

(58) Field of Classification Search

USPC ..... 415/182.1, 183, 185, 186, 203, 204, 415/205, 156, 158, 184, 206, 224.5; 416/181, 185, 186 R, 231 R

See application file for complete search history.

(56) References Cited

U.S. PATENT DOCUMENTS 3,236,500 A * 2/1966 Siegfried ..... 415/150
3,610,775 A * 10/1971 Swearingen ..... 416/186 R (Continued)

FOREIGN PATENT DOCUMENTS

CN 1791737 6/2006
JP 52-109018 9/1977

(Continued)

OTHER PUBLICATIONS

Takagawa et al. JP 2007023893, English Machine Translation, ProQuest Dialog_Translated May 8, 2014.*

(Continued)

*Primary Examiner* — Edward Look
*Assistant Examiner* — Wayne A Lambert
(74) *Attorney, Agent, or Firm* — Wenderoth, Lind & Ponack, LLP

(57) ABSTRACT

A radial turbine includes a radial turbine wheel provided with a main pathway in which blade height progressively increases while curving toward an axial direction from a radial direction. A sub-let is formed on a shroud side of the radial turbine wheel at a position separated from the main inlet in the radial direction and the axial direction. Also, a blade shape that forms the sub-inlet is such that, in a plane orthogonal to the axial line of the radial turbine wheel, a center line of the blade is inclined at a predetermined angle toward the rotation direction with respect to the radial direction.

6 Claims, 8 Drawing Sheets

(56) References Cited

U.S. PATENT DOCUMENTS

| | | | | |
|---|---|---|---|---|
| 3,726,605 | A * | 4/1973 | Bachl | 416/186 R |
| 3,734,650 | A * | 5/1973 | Reisacher et al. | 417/407 |
| 4,111,598 | A * | 9/1978 | Kasuya | 415/202 |
| 4,167,369 | A * | 9/1979 | Ishihara | 416/185 |
| 4,381,171 | A * | 4/1983 | Chapple | 415/204 |
| 5,046,919 | A * | 9/1991 | Wulf | 415/1 |
| 5,094,587 | A * | 3/1992 | Woollenweber | 415/205 |
| 5,161,946 | A * | 11/1992 | Bortz et al. | 415/183 |
| 5,460,003 | A * | 10/1995 | Nenov | 62/651 |
| 5,730,582 | A * | 3/1998 | Heitmann | 416/188 |
| 5,943,864 | A * | 8/1999 | Sumser et al. | 60/602 |
| 6,210,109 | B1 * | 4/2001 | Will et al. | 415/204 |
| 6,672,061 | B2 * | 1/2004 | Schmid et al. | 60/605.2 |
| 6,877,955 | B2 * | 4/2005 | Higashimori et al. | 416/185 |
| 7,395,668 | B2 * | 7/2008 | Gobert et al. | 60/612 |
| 2003/0115875 | A1 * | 6/2003 | Sumser et al. | 60/605.2 |
| 2007/0180826 | A1 * | 8/2007 | Sumser et al. | 60/605.1 |
| 2009/0290980 | A1 * | 11/2009 | Higashimori | 415/205 |
| 2012/0082552 | A1 * | 4/2012 | Osako et al. | 416/223 A |

FOREIGN PATENT DOCUMENTS

| | | |
|---|---|---|
| JP | 58-114844 | 8/1983 |
| JP | 61-202601 | 12/1986 |
| JP | 63-302134 | 12/1988 |
| JP | 1-277627 | 11/1989 |
| JP | 1-285607 | 11/1989 |
| JP | 2007-23893 | 2/2007 |
| JP | 2008-503685 | 2/2008 |
| WO | 2010/150567 | 12/2010 |

OTHER PUBLICATIONS

Hideaki JP 52109018 A, English Translation, Translated by The McElroy Translation Company May 14, 2014.*

Decision to Grant a Patent issued Nov. 26, 2013 in corresponding Japanese Application No. 2011-015584.

Korean Decision to Grant a Patent issued Jan. 28, 2014 in corresponding Korean patent application No. 10-2013-7000829 with English translation.

International Search Report issued Apr. 17, 2012 in International (PCT) Application No. PCT/JP2012/050945.

Written Opinion of the International Searching Authority issued Apr. 17, 2012 in International (PCT) Application No. PCT/JP2012/050945.

Office Action issued Mar. 19, 2014 in corresponding Chinese patent application No. 201280001973.6 with English translation.

* cited by examiner

RADIAL TURBINE

TECHNICAL FIELD

The present invention relates to a radial turbine.

BACKGROUND ART

In a radial turbine provided with a single turbine wheel that converts the swirling energy of a flow of swirling fluid, which flows into the turbine wheel with a flow velocity component in the radial direction serving as the main component thereof, into rotational motive power and that expels the flow, whose energy has been released, in the axial direction thereof, the energy of a low/intermediate-temperature fluid and a high-temperature, high-pressure fluid is converted into rotational motive power; this kind of radial turbine has widely been employed for recovering motive power from discharge energy discharged from various industrial plants in the form of a high-temperature, high-pressure fluid, for recovering exhaust heat from systems that gain motive power via a thermal cycle of a motive-power source or the like in a ship or a vehicle, and for recovering motive power in binary-cycle power generation in which a heat source having a low to intermediate temperature is utilized, such as geothermal power, OTEC, and so forth.

When various energy sources have a plurality of pressures, for example, as disclosed in Patent Literature (PTL) 1, a plurality of turbines, that is, one turbine for each pressure source, have been used. Alternatively, two turbine wheels are coaxially provided in some cases.

This is because radial turbines are designed to meet the optimal conditions for the respective pressures of the fluids. For example, the inlet radius R of a radial turbine is determined by the relationship $g \cdot H \approx U^2$, where g is the gravitational acceleration, H is the head, and U is the inlet circumferential velocity of a turbine wheel. Specifically, assuming that the rotational speed of the turbine wheel is N (rpm), a value close to $R \approx U/2 \cdot \pi/(N/60)$ is set as the inlet radius R.

In addition, in a radial turbine that handles fluids having large flow-volume change, for example, as disclosed in Patent Literature 2, there is a known radial turbine in which a single inlet flow channel is divided by partitioning it with a partition wall. However, in this case, the size of the Inlet is changed in accordance with the flow volumes of fluids having the same pressure.

However, this is a case in which the fluids having the same pressure are handled by both inlet flow channels. In addition, because the two inlet flow channels are provided so as to be adjacent to each other simply by partitioning them with the partition wall, when handling fluids having different pressures, a high-pressure fluid leaks toward a low-pressure fluid, thus decreasing the turbine efficiency.

CITATION LIST

Patent Literature

{PTL 1} Japanese Unexamined Patent Application, Publication No. Hei 1-285607

{PTL 2} Japanese Unexamined Patent Application, Publication No. Sho 63-302134

SUMMARY OF INVENTION

Technical Problem

When a plurality of turbines are employed as disclosed in Patent Literature 1, the manufacturing cost increases and the installation space also increases.

In addition, when a plurality of turbine wheels are coaxially provided, the number of turbine parts increases, the structure thereof becomes complex, and the manufacturing cost increases.

The present invention has been conceived in light of the above-described circumstances, and an object thereof is to provide a radial turbine in which fluids having a plurality of pressures are handled with a single or integrated turbine wheel and for which the cost thereof is reduced by decreasing the number of parts.

In addition, it is also an object of the present invention to provide a radial turbine with which a decrease in the turbine efficiency can be suppressed and a sufficient space for a bearing box and so forth can be ensured.

Solution to Problem

In order to solve the above-described problems, the present invention employs the following solutions.

Specifically, a first aspect of the present invention is a radial turbine including a turbine wheel that is provided with a main pathway in which a blade height progressively increases while curving toward an axial direction from a radial direction, that converts swirling flow energy from a swirling fluid that flows into the main pathway from a main inlet positioned on an outer circumferential side and having a flow in the radial direction as the main component thereof into rotational motive power, and that expels the flow, whose energy has been released, in the axial direction, wherein a sub-inlet into which flows a fluid whose pressure differs from pressure of the fluid supplied from the main inlet is formed on a shroud side of the turbine wheel at a position separated from the main inlet in the radial direction and the axial direction; and a blade shape that forms the sub-inlet is such that, in a plane orthogonal to the axial line of the turbine wheel, a center line of the blade is inclined at a predetermined angle toward the rotation direction with respect to the radial direction.

With this aspect, the fluid is introduced to an outer circumferential end of the main pathway of the turbine wheel from the main inlet. While progressively decreasing in pressure, the fluid introduced from the main inlet travels along the main pathway, in which the blade height progressively increases while curving from the radial direction to the axial direction, is expelled from the turbine wheel, and generates motive power at the rotating shaft to which the turbine wheel is attached.

The sub-inlet is formed on the shroud side of the turbine wheel at the position separated from the main inlet in the radial direction and the axial direction, and the fluid whose pressure differs from the pressure of the fluid supplied from the main inlet flows into the sub-inlet, wherein, specifically, the pressure thereof is lower than that of the fluid that flows into the main inlet. The fluid introduced from the sub-inlet is mixed with fluids introduced from the main inlet and sub-inlet on the upstream side, flows out of the turbine wheel while progressively decreasing in pressure, and generates motive power at the rotating shaft to which the turbine wheel is attached.

Because a casing exists between the main inlet and the sub-inlet, as well as between the individual sub-inlets, the fluids are clearly separated and leakage thereof can be prevented.

In this way, rotational motive power can be extracted from fluids having the plurality of pressures by means of a single turbine wheel. Accordingly, the number of parts can be reduced and the manufacturing cost can be reduced.

At this time, because the blade shape that forms the sub-inlet is such that, in the plane orthogonal to the axial line of the turbine wheel, the center line of the blade is inclined at the predetermined angle toward the rotation direction with respect to the radial direction, the magnitude of the swirling flow velocity component of the fluid that flows thereinto becomes smaller than that of the circumferential velocity of the turbine wheel, that is, the blade, at that position.

The head, that is, the pressure of the fluid that flows into the turbine wheel, is proportional to a value obtained by multiplying the swirling flow velocity component of the fluid by the circumferential velocity of the blade. In a turbine wheel in which, in the plane orthogonal to the axial line of the turbine wheel, the center line of the blade is not inclined in the rotation direction with respect to the radial direction, generally at a design point, the swirling flow velocity component of the fluid at the outlet of the turbine wheel is set to be zero, and thus, the head at the inlet is set so that the swirling flow velocity component of the fluid and the circumferential velocity of the blade become equal to each other.

In this aspect, because the magnitude of the swirling flow velocity component of the fluid that flows in becomes smaller than that of the circumferential velocity of the turbine wheel, that is, the blade, at that position, when the heads are set to be the same, that is, when the product of the swirling flow velocity component of the fluid and the circumferential velocity of the blade is assumed to be constant, the circumferential velocity of the blade can be increased as compared with a general case. In other words, the radial position of the sub-inlet can be set at a position closer to the main inlet.

By setting the radial position of the sub-inlet at a position closer to the main inlet, because an angle at which flow directions of the fluid that flows in from the main inlet and the fluid that flows in from the sub-inlet intersect is reduced, enabling smooth joining therebetween, it is possible to further reduce a pressure loss caused by a collision between the two flows. Accordingly, it is possible to suppress a decrease in the turbine efficiency of the radial turbine.

With the above-described aspect, in a cylindrical surface centered on the axial center of the turbine wheel, a line tangent to a leading edge of the blade that forms the sub-inlet may be inclined so as to be opened from the axial center on the tip side of the blade.

By doing so, the main-inlet side of the blade that forms the sub-inlet can be brought closer to the blade that forms the main inlet. Therefore, the main-inlet side of the blade that forms the sub-inlet can be made continuous with the blade that forms the main inlet.

In this case, this continuation can be made smoother by inclining, in the cylindrical surface that is centered on the axial center of the turbine wheel, the blade extending from the main inlet so as to be opened from the axial center toward the blade at the sub-inlet.

By forming the blade, which has the main inlet, and the blade, which has the sub-inlet, so as to form a continuous blade surface in this way, it is possible to design the blade as if the blade has a single continuous blade surface by using a conventional method, and it is also possible to integrally manufacture the blade by using a conventional blade manufacturing technique.

A second aspect of the present invention is a radial turbine including a turbine wheel that is provided with a main pathway in which a blade height progressively increases while curving toward an axial direction from a radial direction, that converts swirling flow energy from a swirling fluid that flows into the main pathway from a main inlet positioned on an outer circumferential side and having a flow in the radial direction as the main component thereof into rotational motive power and that expels the flow, whose energy has been released, in the axial direction, wherein the turbine wheel is provided with a sub-pathway at a position radially inward of the main inlet, which branches from a hub surface of the main pathway and extends toward a back-face side of the main pathway; a sub-inlet into which a fluid whose pressure differs from the pressure of the fluid supplied from the main inlet is supplied is formed at an outer circumferential end of the sub-pathway at a radial position different from that of the main inlet; and a blade shape that forms the sub-inlet is such that, in a plane orthogonal to the axial line of the turbine wheel, a center line of the blade is inclined at a predetermined angle toward the rotation direction with respect to the radial direction.

With this aspect, the fluid is introduced to an outer circumferential end of the main pathway of the turbine wheel from the main inlet. While progressively decreasing in pressure, the fluid introduced from the main inlet travels along the main pathway, in which the blade height progressively increases while curving from the radial direction to the axial direction, is expelled from the turbine wheel, and generates motive power at the rotating shaft to which the turbine wheel is attached.

The fluid whose pressure differs from the pressure of the fluid supplied from the main inlet is introduced to the outer circumferential end of the sub-pathway from the sub-inlet. This fluid is supplied to the main pathway from the hub surface of the main pathway by passing through the sub-pathway and is mixed with the fluid introduced from the main inlet. The mixed fluid flows out from the turbine wheel while progressively decreasing in pressure and generates motive power at the rotating shaft to which the turbine wheel is attached.

In order to clearly separate the fluids and to reduce leakage thereof, it is preferable that the main inlet and the sub-inlet be separated by a gap adjusted between the back plate of the turbine wheel that forms the main pathway and the casing.

In this way, rotational motive power can be extracted from fluids having the plurality of pressures by means of a single or integrated turbine wheel. Accordingly, the number of parts can be reduced, and the manufacturing cost can be reduced.

At this time, because the blade shape that forms the sub-inlet is such that, in the plane orthogonal to the axial line of the turbine wheel, the center line of the blade is inclined at the predetermined angle toward the rotation direction with respect to the radial direction, the magnitude of the swirling flow velocity component of the fluid that flows thereinto becomes smaller than that of the circumferential velocity of the turbine wheel, that is, the blade, at that position.

The head, that is, the pressure of the fluid that flows into the turbine wheel, is proportional to a value obtained by multiplying the swirling flow velocity component of the fluid by the circumferential velocity of the blade. In a turbine wheel in which, in the plane orthogonal to the axial line of the turbine wheel, the center line of the blade is not inclined in the rotation direction with respect to the radial direction, generally at a design point, the swirling flow velocity component of the fluid at the outlet of the turbine wheel is set to be zero, and thus, the head at the inlet is set so that the swirling flow velocity component of the fluid and the circumferential velocity of the blade become equal to each other.

In this aspect, because the magnitude of the swirling flow velocity component of the fluid that flows in becomes smaller than that of the circumferential velocity of the turbine wheel, that is, the blade, at that position, when the heads are set to be the same, that is, when the product of the swirling flow velocity component of the fluid and the circumferential velocity of the blade is assumed to be constant, the circumferential velocity of the blade can be increased as compared with a general case. In other words, the radial position of the sub-inlet can be set at a position closer to the main inlet.

By setting the radial position of the sub-inlet at a position closer to the main inlet, because the pathway for making the fluid flow into the sub-inlet can be provided at a position away from the rotating shaft, it is possible to ensure a sufficient space for a bearing box or the like to be provided around the rotating shaft.

For each of the above-described aspects, it is preferable that the predetermined angle described above be 10° or greater.

Advantageous Effects of Invention

With the present invention, on a shroud side of the turbine wheel, a plurality of sub-inlets are formed at positions separated from the main inlet in the radial direction and the axial direction or a sub-pathway and a sub-inlet that branch from a hub surface of a main pathway and that extend toward the back face side of the main pathway are provided; therefore, rotational motive power can be extracted from fluids having a plurality of pressures by means of a single or integrated turbine wheel. Accordingly, the number of parts can be reduced, and the manufacturing cost can be reduced.

At this time, because a blade shape that forms the sub-inlet is such that, in a plane orthogonal to the axial line of the turbine wheel, the center line of the blade is inclined at a predetermined angle toward the rotation direction with respect to the radial direction, it is possible to suppress a decrease in the turbine efficiency of the radial turbine, or it is possible to ensure a sufficient space for a bearing box or the like to be provided around the rotating shaft.

DESCRIPTION OF EMBODIMENTS

Embodiments of the present invention will be described in detail below by using the drawings.

First Embodiment

A radial turbine 100 according to a first embodiment of the present invention will be described below with reference to FIGS. 1 to 5.

Figure 1:
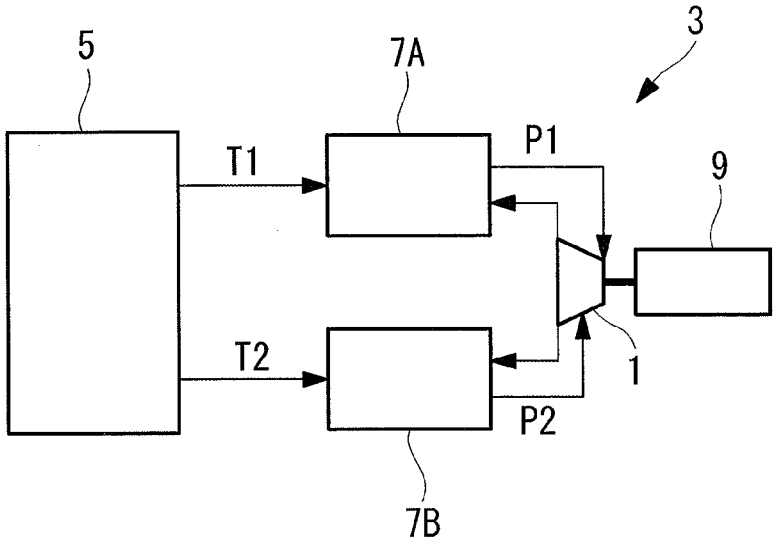
FIG. 1 is a block diagram showing the configuration of a binary power generation system employing an expansion turbine according to a first embodiment of the present invention.
Figure 2:
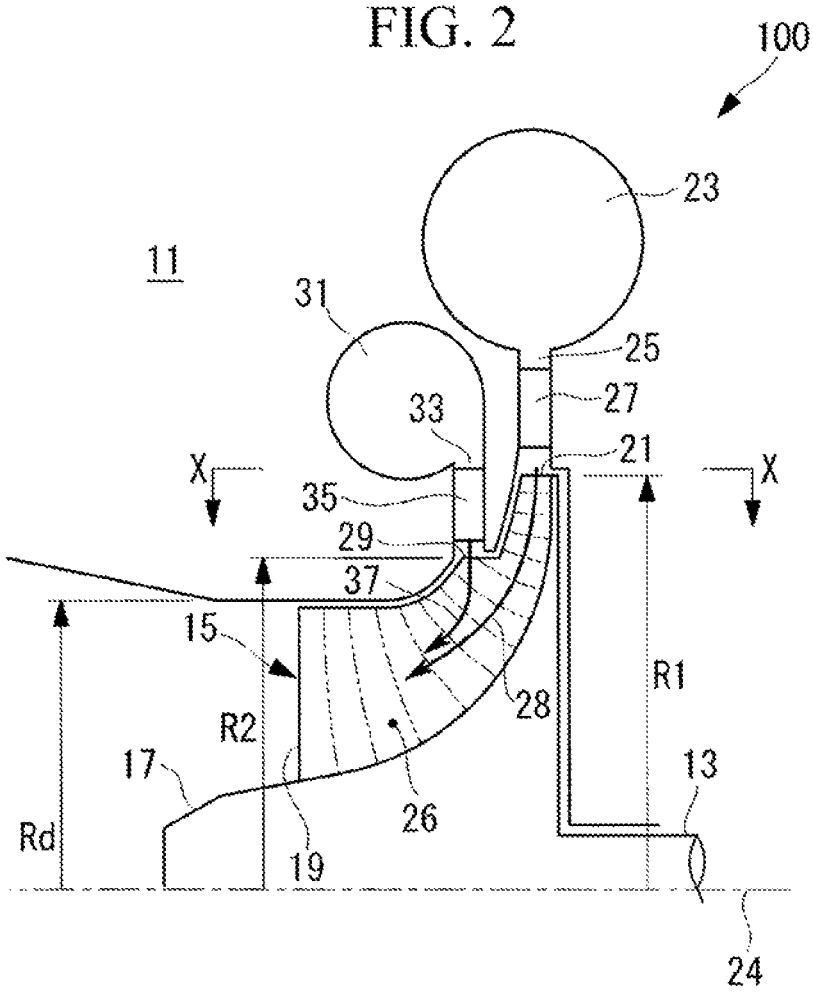
FIG. 2 is a partial sectional view of a radial turbine employed as the expansion turbine in FIG. 1.
Figure 3:
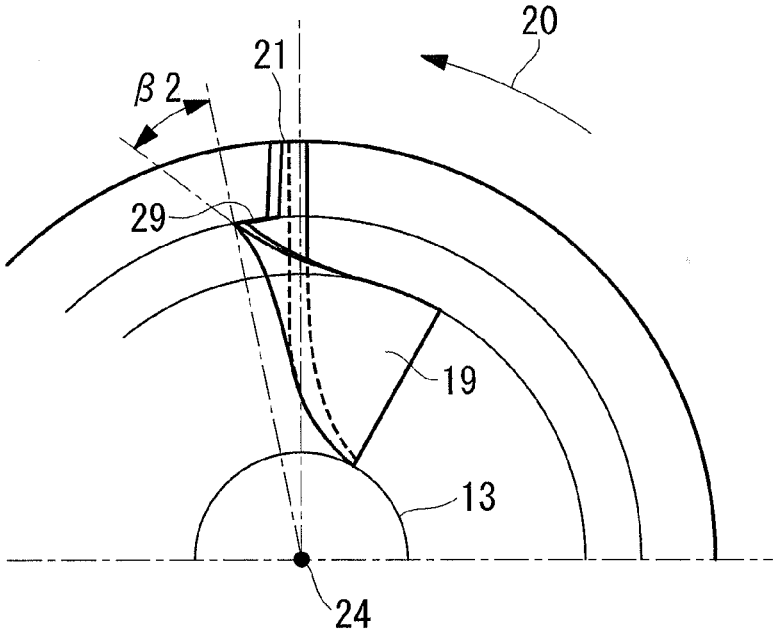
FIG. 3 is a front view of a radial blade in FIG. 2 viewed in the axial direction.
Figure 4:
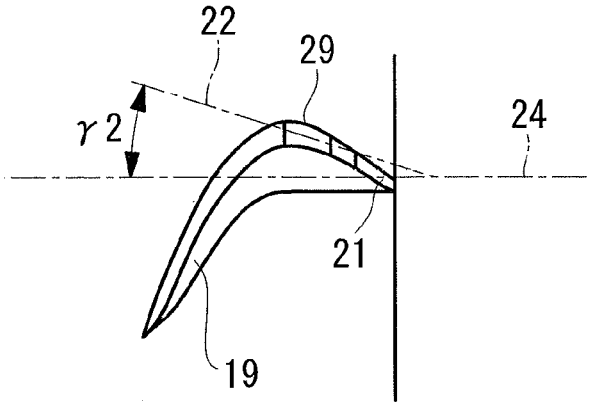
FIG. 4 is a diagram of the radial blade in FIG. 2 showing a view taken along X-X.
Figure 5:
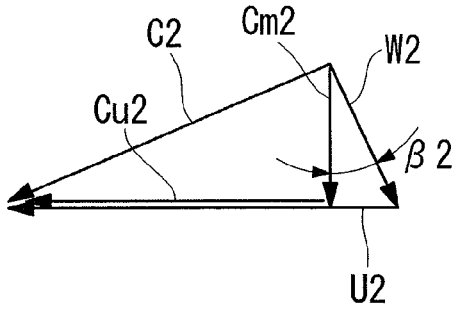
FIG. 5 is a diagram showing a velocity triangle for a sub-inlet in FIG. 2.

FIG. 1 is a block diagram showing the configuration of a binary power generation system employing an expansion turbine according to the first embodiment of the present invention. FIG. 2 is a partial sectional view showing the radial-turbine shape for the case in which a radial turbine of the present invention is employed as the expansion turbine in FIG. 1. FIG. 3 is a front view of a radial blade in FIG. 2 viewed in the axial direction. FIG. 4 is a diagram of the radial blade in FIG. 2 showing a view taken along X-X. FIG. 5 is a diagram showing a velocity triangle for a sub-inlet.

A binary power generation system 3 is, for example, a system used for geothermal power generation. The binary power generation system 3 is provided with a heat source unit 5 having a plurality of heat sources, two binary cycles 7A and 7B, an expansion turbine 1, and a generator 9 that generates electric power by means of the rotational motive power of the expansion turbine 1.

The heat source unit 5 supplies steam or hot water heated by geothermal heat to the binary cycles 7A and 7B. The heat source unit 5 is configured to supply two types of steam or hot water having different temperatures T1 and T2 as well as different pressures.

The binary cycles 7A and 7B are formed as Rankine cycles in which low-boiling-point media (fluids) are circulated as working fluids. As the low-boiling-point media, for example, organic media such as isobutane or the like, chlorofluorocarbon, chlorofluorocarbon substitutes, ammonia, a mixed fluid of ammonia and water, and so forth are employed.

At the binary cycles 7A and 7B, the low-boiling-point media are heated by high-temperature steam or hot water from the heat source unit 5 and are turned into high-pressure fluids, which are then supplied to the expansion turbine 1. The low-boiling-point media discharged from the expansion turbine 1 are returned to the binary cycles 7A and 7B to be heated again by the high-temperature steam or hot water, and these processes are sequentially repeated.

At this time, at the two binary cycles 7A and 7B, the same low-boiling-point media are used. Because the high-temperature steam or hot water supplied to the binary cycles 7A and 7B differs in temperature, pressures P1 and P2 of the low-boiling-point media supplied therefrom to the expansion turbine 1 are different. The pressure P1 is greater than the pressure P2.

The radial turbine 100 is provided with a casing 11, a rotating shaft 13 that is supported in the casing 11 in a rotatable manner, and a radial turbine wheel (turbine wheel) 15 attached to the outer circumference of the rotating shaft 13.

The radial turbine wheel 15 is formed of a hub 17 that is attached to the outer circumference of the rotating shaft 13 and a plurality of blades 19 that are provided on the outer circumferential surface of the hub 17 in a radiating manner with spaces therebetween.

At an outer circumferential end of the radial turbine wheel 15, main inlets 21 are formed around the entire circumference thereof at positions at a radius R1. An inlet flow channel 25 is formed on the outer circumferential side of the main inlets 21 as a ring-like space. At an end of the inlet flow channel 25 on the outer circumferential side thereof, a main inflow channel 23 is formed, to which the low-boiling-point medium having the pressure P1 supplied from the binary cycle 7A is introduced.

Nozzles 27 that are formed of a plurality of blades disposed in the circumferential direction with spaces therebetween and that generate a high-speed swirling flow are provided at the inlet flow channel 25.

Also, the high-speed swirling flow may be generated by means of a high-speed-swirling-flow generating flow channel, such as a scroll without nozzle blades.

A main pathway 26 is formed in the radial turbine wheel 15, which is curved toward the axial direction from the radial direction so that a flow from the main inlet 21 flows out toward a turbine wheel outlet.

On a shroud side of the radial turbine wheel 15, a sub-inlet 29 is formed at a position at a radius R2 that is separated in the radial direction and the axial direction from the main inlet 21.

An inlet flow channel 33 is formed at the outer circumferential side of the sub-inlet 29 as a ring-like space. At an end of the inlet flow channel 33 on the outer circumferential side thereof, an inflow sub-channel 31 is formed, to which the low-boiling-point medium having the pressure P2 supplied from the binary cycle 7B is introduced.

Nozzles 35 are provided at the inlet flow channel 33, which are formed of a plurality of blades disposed in the circumferential direction with spaces therebetween.

In FIG. 2, isobars for the fluids that pass through the interior of the radial turbine wheel 15 are indicated by one-dot-chain lines.

The radius R2 is set so that the pressure of the fluid supplied from the sub-inlet 29 becomes substantially the same as the pressure of the fluid that passes through this position in the radial turbine wheel 15.

The blades 19 have blade shapes that radiate at substantially the same angles with respect to an axial center 24 at the main inlet 21 on the hub 17 side thereof, and the blade shapes are such that angles of the blades increase with respect to the rotating shaft 13 in a parabolic manner toward the outlet of the radial turbine wheel 15.

As shown in FIG. 3, the blade shape that forms the sub-inlet 29 is such that, in a plane orthogonal to the axial line of the rotating shaft 13, the center line of the blade 19 is inclined toward the downstream side in a rotation direction 20 at an angle (predetermined angle) β2 with respect to the radial direction. It is preferable that the angle β2 be 10° or greater.

Also, as shown in FIG. 4, in a cylindrical surface centered on the axial center 24 of the rotating shaft 13, a line 22 tangent to a leading edge is inclined so as to be opened from the axial center 24 on the tip side of the blade 19. An inclination angle of the line 22 with respect to the axial center 24 of the rotating shaft 13 is set to be an angle γ2.

The main inlet 21 is provided at the position at the radius R1, and the sub-inlet 29 is provided at the position at the radius R2.

The blade shape of the blade 19 near the main inlet 21 is formed so that, in the plane orthogonal to the axial line of the rotating shaft 13, the center line of the blade 19 extends substantially parallel to the radial direction. Therefore, the radius R1 of the main inlet 21 is set as follows. There is a relationship $g \cdot H1 \approx U1^2$ with regard to the inlet pressure P1 and a head H1. Assuming that the rotational speed of the radial turbine wheel 15 is N (rpm), the radius R1 of the main inlet 21 is set to be a value close to $R1 \approx U1/2 \cdot \pi/(N/60)$.

This is more precisely expressed as $g*H1=Cu1*U1-Cud*Ud$ (where Cu1 is the swirling flow velocity component at the main inlet 21, Cud is a representative swirling flow velocity component at the outlet of the radial turbine wheel 15, and Ud is a representative circumferential velocity at the outlet of the radial turbine wheel 15), and, because the settings at a design point are generally $Cud \approx 0$ and $Cu1 \approx U1$, consequently, the radius R1 of the main inlet 21 is set by using the above-described relationship.

On the other hand, the blade shape near the sub-inlet 29 is such that, in the plane orthogonal to the axial line of the rotating shaft 13, the center line of the blade 19 is inclined toward the downstream side in the rotation direction 20 at the angle (predetermined angle) β2 with respect to the radial direction.

In this case, a velocity triangle for the sub-inlet 29 is as shown in FIG. 5. In other words, the absolute flow velocity C2 of the fluid flowing into the sub-inlet 29 is decomposed into the meridian flow velocity component Cm2 and the swirling flow velocity component Cu2. In addition, the absolute flow velocity C2 is decomposed into the relative flow velocity W2 along the blade surface and the circumferential velocity U2 of the radial turbine wheel 15.

The magnitude of the swirling flow velocity component Cu2 of the fluid that flows in according to the relative flow velocity W2 along the blade surface inclined at the angle β2 near the sub-inlet 29 is lower than the circumferential velocity U2 of the radial turbine wheel 15 at that position. In other words, the magnitudes of the swirling flow velocity component Cu2 and that of the circumferential velocity U2 are different.

Therefore, the radius R2 of the sub-inlet 29 is set as follows. There is a relationship $g*H2 \approx Cu2*U2$ with regard to the inlet pressure P2 and the head H2 at the sub-inlet 29. Assuming that the rotational speed of the radial turbine wheel 15 is N (rpm), the radius R2 of the sub-inlet 29 is set to be a value close to $R2 \approx U2/2 \cdot \pi/(N/60)$.

This is more precisely expressed as $g*H2=Cu2*U2-Cud*Ud$, and, because the setting at the design point is generally $Cud \approx 0$, consequently, the radius R2 of the sub-inlet 29 is set by using the above-described relationship.

As a comparative example, a radial turbine wheel 15 shown in FIG. 6 will be described, in which a sub-inlet 30 is provided, wherein a blade shape thereof is formed so that, in the plane orthogonal to the axial line of the rotating shaft 13, the center line of the blade 19 extends substantially parallel to the radial direction, and other parts are the same as this embodiment. FIG. 7 shows a velocity triangle for the sub-inlet 30 of the radial turbine wheel 15 in FIG. 6.

As with the radius R1 at the main inlet 21, for radius R2' at a position where the sub-inlet 30 is provided, there is a relationship $g*H2' \approx U2'^2$ ($\approx Cu2' \cdot U2'$) with regard to an inlet pressure P2' and a head H2'. Assuming that the rotational speed of the radial turbine wheel 15 is N (rpm), the radius R2' of the sub-inlet 30 is set to be a value close to $R2' \approx U2'/2 \cdot \pi/(N/60)$.

The relationship is expressed as $g \cdot H2 \approx Cu2*U2$ for the sub-inlet 29, whereas it is expressed as $g \cdot H2' \approx U2'^2$ ($\approx Cu2'*U2'$) for the sub-inlet 30.

When setting the head H2 for the sub-inlet 29 and the head H2' for the sub-inlet 30 to be the same in these relationships, this can be achieved by, for example, using a constant α that is equal to 1 or greater for the swirling flow velocity component Cu2' and the circumferential velocity U2' for the sub-inlet 30, where $Cu2' \approx U2'$, so that $Cu2=Cu2'/\alpha$ and $U2=U2'*\alpha$, because the swirling flow velocity component Cu2 is smaller than the circumferential velocity U2 for the sub-inlet 29, as described above. At this time, if the rotational speed is constant, the relationship between the radius R2 of the sub-inlet 29 and the radius R2' of the sub-inlet 30 is given as the radius R2=R2'*α.

Therefore, when the heads H are the same, the radius R2 of the sub-inlet 29 can be made larger than the radius R2' of the sub-inlet 30.

Because the line 22 tangent to the leading edge of the sub-inlet 29 is inclined so as to be opened from the axial center 24 on the tip side of the blade 19 at the angle γ2, in a cylindrical surface centered on the axial center 24 of the rotating shaft 13, the main-inlet 21 side of the blade 19, which forms the sub-inlet 29, can be made closer to the blade 19, which forms the main inlet 21. Therefore, as shown in FIG. 4, the blade surface of the blade 19 that forms the sub-inlet 29 can be made continuous with the blade surface of the blade 19 that forms the main inlet 21.

In this way, by forming the main inlet 21 and the sub-inlet 29 so as to form a continuous blade surface, it is possible to design the blade 19 as if it has a single continuous blade surface by using a conventional method, and it is also possible to integrally manufacture the blade by using a conventional blade manufacturing technique.

In this case, in the cylindrical surface centered on the axial center 24, a portion of the blade 19 extending from the main inlet 21 may be inclined so as to be opened from the axial center 24 toward the sub-inlet 29. By doing so, the main inlet 21 and the sub-inlet 29 can be made continuous more smoothly.

The operation of the thus-configured radial turbine 100 according to this embodiment will be described below.

The low-boiling-point medium having the pressure P1 supplied from the binary cycle 7A passes through the inlet flow channel 25 from the main inflow channel 23, the flow volume and flow velocity thereof are adjusted by the nozzles 27, and the low-boiling-point medium is supplied to the main pathway 26 from the main inlet 21 at a flow volume G1. This low-boiling-point medium flows toward the outlet of the radial turbine wheel 15 while curving along the main pathway 26, forming a flow 28. At this time, the pressure of the low-boiling-point medium supplied to the radial turbine wheel 15 is PN1. This low-boiling-point medium having the pressure PN1 travels along the main pathway 26 to flow out from the radial turbine wheel 15, while continuously decreasing in pressure until reaching an outlet pressure Pd of the radial turbine wheel 15, thus generating rotational motive power at the rotating shaft 13 to which the radial turbine wheel 15 is attached.

At this time, the low-boiling-point medium having the pressure P2 supplied from the binary cycle 7B passes through the inlet flow channel 33 from the inflow sub-channel 31, the flow volume and flow velocity thereof are adjusted by the nozzles 35, and the low-boiling-point medium is supplied to the radial turbine wheel 15 from the sub-inlet 29 at a flow volume G2.

At this time, a pressure PN2 of the low-boiling-point medium supplied to the radial turbine wheel 15 from the sub-inlet 29 is set to be equal to the pressure of the low-boiling-point medium at a position of the sub-inlet 29, which flows in the radial turbine wheel 15 and which progressively, in other words, continuously, decreases in pressure toward the outlet of the radial turbine wheel 15.

The low-boiling-point medium supplied to the sub-inlet 29 flows, forming a flow 37, and joins with the low-boiling-point medium introduced from the main inlet 21.

When the flow volume is large, in many cases, the radius Rd of the outlet of the radial turbine wheel 15 is set to be about 0.6 to 0.7 times the radius R1 of the main inlet 21. For example, when the radial turbine wheel 15 provided with the sub-inlet 30 shown in FIG. 6 is employed, assuming that the head H2' of the low-boiling-point medium that flows into the sub-inlet 30 is 0.5 times the head H1 at the main inlet 21, the radius R2' where the sub-inlet 30 is provided is 0.707 times, the radius R1 of the main inlet 21.

Under such conditions, the flow 28 that has flowed in from the main inlet 21 and the flow 37 that has flowed in from the sub-inlet 30 cannot flow so that the vectors of representative velocities of the flows at the meridian plane therebetween are parallel to each other, which causes the flows 28 and 37 to collide with each other, and therefore, the pressure loss of the flows increases.

Figure 6:
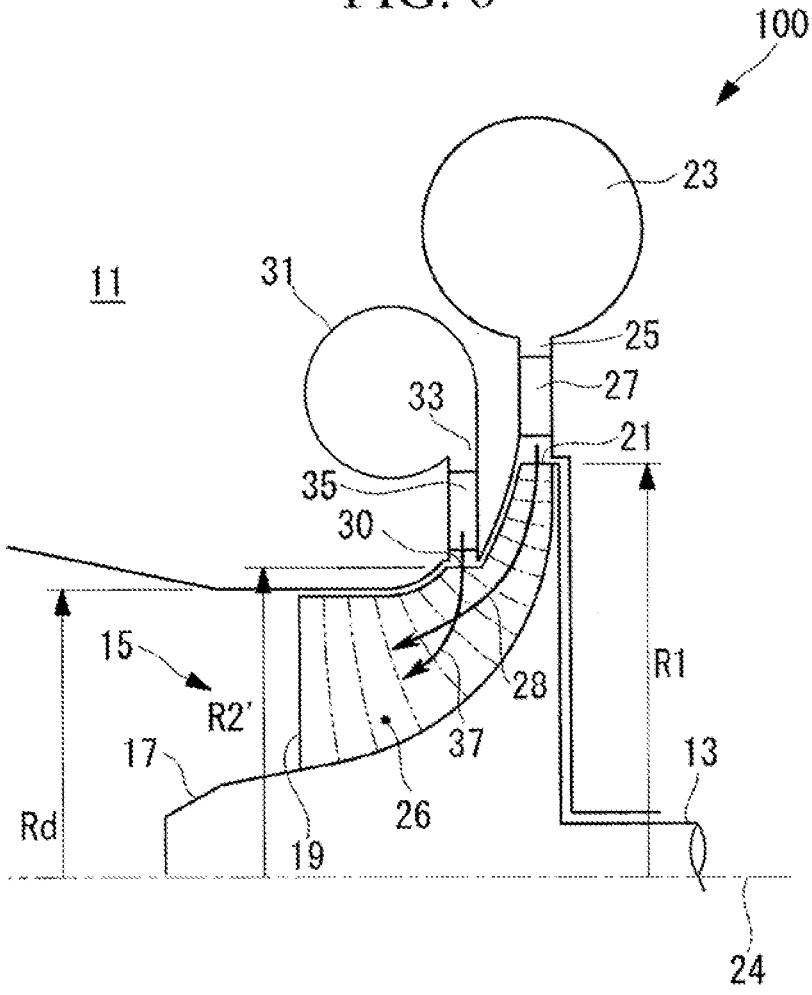
FIG. 6 is a partial sectional view showing a comparative example for the radial turbine according to the first embodiment of the present invention.
Figure 7:
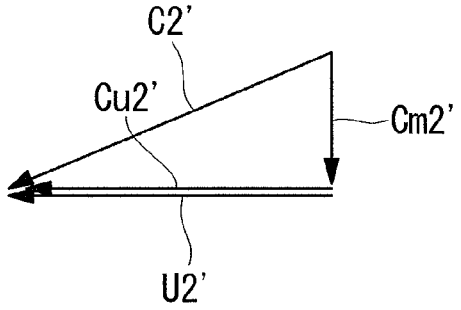
FIG. 7 is a diagram showing a velocity triangle for a sub-inlet in FIG. 6.

In this embodiment, when the heads are the same as the heads of the embodiment shown in FIG. 6, the radial position where the sub-inlet 29 is provided, for which the blade shape of the blade 19 is such that, in the plane orthogonal to the axial line of the rotating shaft 13, on the downstream side in the rotation direction 20, the center line thereof is inclined at the angle β2 with respect to the radial direction, can be made larger than the radial position where the sub-inlet 30 is provided, for which the blade shape of the blade 19 is such that, in the plane orthogonal to the axial line of the rotating shaft 13, the center line thereof is substantially parallel to the radial direction; therefore, an angle at which the flow 28 of the low-boiling-point medium that flows in from the main inlet 21 intersects with the flow 37 of the low-boiling-point medium that flows in from the sub-inlet 29 can be made smaller than that for the case of the sub-inlet 30. Therefore, because the low-boiling-point medium from the main inlet 21 and the low-boiling-point medium from the sub-inlet 29 can be joined more smoothly than the case of the sub-inlet 30, the pressure loss due to a collision between the two flows can be reduced. Accordingly, it is possible to suppress a decrease in the turbine efficiency of the radial turbine 100.

The low-boiling-point medium that has flowed in from the sub-inlet 29 at the flow volume G2 is mixed with the low-boiling-point medium that has been supplied from the main inlet 21 at the flow volume G1, and the combined flow flows out from the outlet of the radial turbine wheel 15. The low-boiling-point medium having a combined flow volume of the flow volume G1 and the flow volume G2 generates rotational motive power at the rotating shaft 13 via the radial turbine wheel 15.

The generator 9 generates electric power by means of the rotating shaft 13 that is rotationally driven.

In this way, by supplying the low-boiling-point media having different pressures to the main inlet 21 and the sub-inlet 29 of the radial turbine wheel 15 from the binary cycles 7A and 7B, respectively, rotational motive power can be extracted by means of a single radial turbine wheel 15.

By doing so, the number of parts in the radial turbine 100 according to this embodiment can be reduced as compared with a plurality of expansion turbines or an expansion turbine provided with a plurality of radial turbine wheels, and thus, the manufacturing cost thereof can be reduced.

Note that, although a shroud is not provided in the radial turbine wheel 15 in this embodiment, it is not limited thereto.

For example, a shroud may be attached to the radial turbine wheel 15, positioned between the main inlet 21 and the sub-inlet 29. Also, in addition to this shroud, a shroud may be provided between the outlet of the radial turbine wheel 15 and the sub-inlet 29.

By doing so, it is possible to reduce a leakage loss of the low-boiling-point medium due to the clearance at the blade tip between the main inlet 21 and the sub-inlet 29, and thus, it is possible to increase the turbine efficiency.

Furthermore, although the sub-inlet 29 is provided at one location in this embodiment, it may be provided at multiple locations.

By doing so, rotational motive power can be extracted from low-boiling-point media having three or more different pressures by means of a single radial turbine wheel 15, a further reduction in the number of parts thereof is possible, and the manufacturing cost can be reduced.

Although a case in which the present invention is employed in the binary power generation system 3 having the two binary cycles 7A and 7B has been described in this embodiment, the usage of the expansion turbine 1 is not limited thereto.

Figure 8:
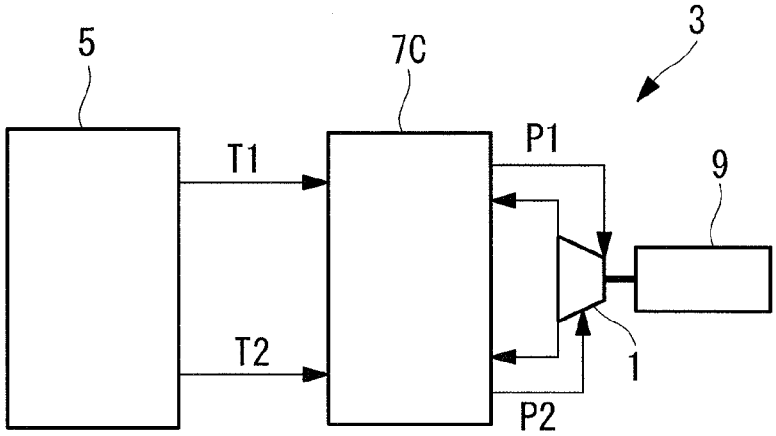
FIG. 8 is a block diagram showing another configuration of the binary power generation system employing the expansion turbine according to the first embodiment of the present invention.

For example, as shown in FIG. 8, the present invention can also be employed in a binary power generation system 3 having one binary cycle 7C. In this case, motive power is recovered by the expansion turbine 1 by extracting low-boiling-point media having different pressures from the binary cycle 7C.

Figure 9:
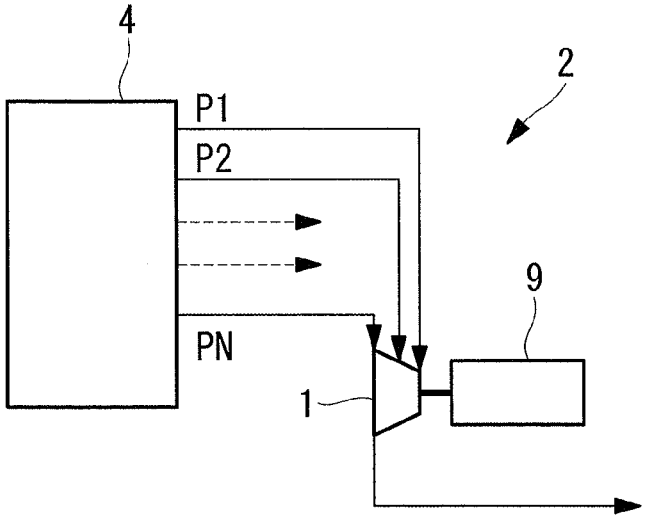
FIG. 9 is a block diagram showing the configuration of a plant system employing the expansion turbine according to the first embodiment of the present invention.

In addition, the expansion turbine 1 may be employed in a plant system 2 shown in FIG. 9. The plant system 2 is, for example, a system in which motive power is recovered by the expansion turbine 1 by extracting steam (fluid) having a plurality of, for example, three, different pressures in a boiler plant 4.

The plant system 2 includes various types of industrial plant, and the present invention may be employed in, for example, a mixing step in processes involved in separation and mixing at a chemical plant.

Second Embodiment

Next, a radial turbine 100 according to a second embodiment of the present invention will be described by using FIGS. 10 to 12.

Because this embodiment differs from the first embodiment in terms of the configuration of the turbine wheel, portions that are different will mainly be described here, and redundant descriptions for portions that are the same as those in the first embodiment described above will be omitted.

Note that, the same reference signs are assigned to members that are the same as those in the first embodiment.

Figure 10:
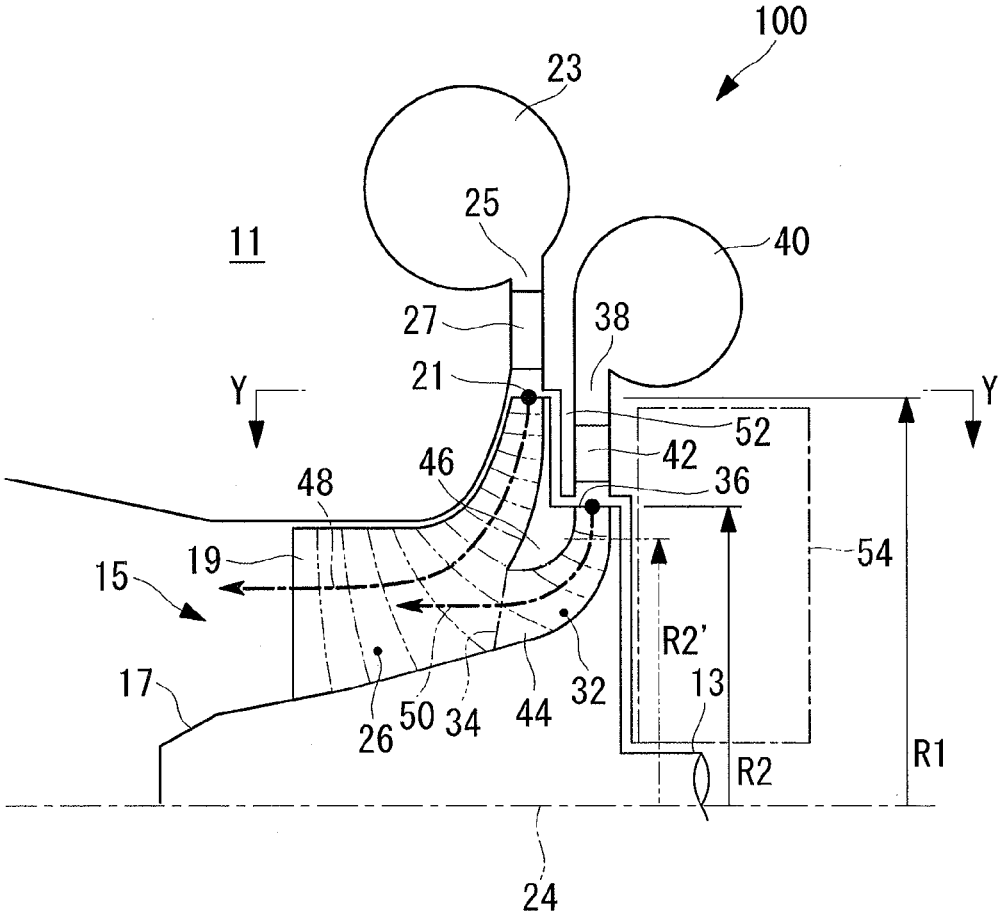
FIG. 10 is a partial sectional view showing a radial turbine according to a second embodiment of the present invention.

FIG. 10 is a partial sectional view showing a radial turbine 100 according to the second embodiment of the present invention. FIG. 11 is a front view of a radial blade in FIG. 10 viewed in the axial direction. FIG. 12 is a diagram of the radial blade in FIG. 10 showing a view taken along Y-Y.

In this embodiment, a sub-pathway 32 that extends toward a back-face side is provided at a hub surface of the main pathway 26. Flows in the main pathway 26 and the sub-pathway 32 join at a joining portion 34, which is a virtual line at the hub surface of the main pathway 26 indicated by a one-dot chain line. In other words, the sub-pathway 32 is formed so as to be branched from the joining portion 34 and to extend toward the back-face side of the main pathway 26.

At an outer circumferential end of the sub-pathway 32 on the back-face side, a sub-inlet 36 that extends over the entire circumference is provided at a position at a radius R2 that is different from that of the main inlet 21.

An inlet flow channel 38 is formed as a ring-like space on the outer circumferential side of the sub-inlet 36 provided at the position at the radius R2. An inflow sub-channel 40, to which the low-boiling-point medium having the pressure P2 supplied from the binary cycle 7B is introduced, is connected to an outer circumferential end of the inlet flow channel 38.

Nozzles 42 that are formed of a plurality of blades disposed in the circumferential direction with spaces therebetween are provided at the inlet flow channel 38.

A branching pathway wall (blade) 44 that is branched at the joining portion 34 and partitions the sub-pathway 32 in the circumferential direction is formed in the blade 19 of the radial turbine wheel 15.

A back plate 46 is provided between the back face of the blade 19 that extends from the main inlet 21 to the joining portion 34 and the shroud side of the branching pathway wall 44.

The main pathway 26 is formed by adjacent blades 19, the hub 17, the back plate 46, and the casing 11. The sub-pathway 32 is formed by the branching pathway walls 44 of the adjacent blades 19, the hub 17, and a surface of the back plate 46 facing radially inward.

As shown in FIG. 10, the trailing edge of the blade 19 is formed as a line substantially in the radial direction so that the low-boiling-point medium flows out having a component in substantially the axial direction.

Figure 12:
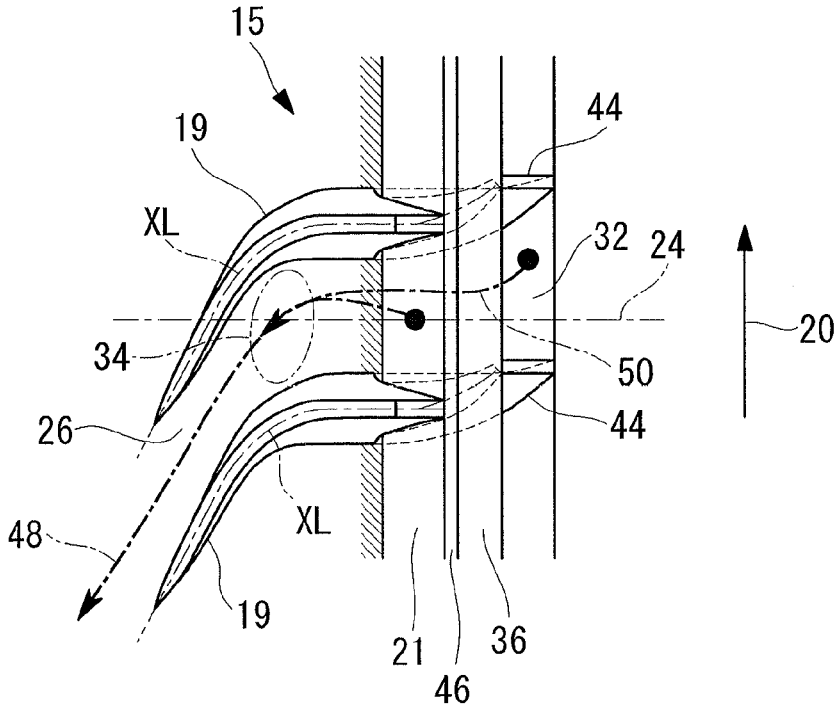
FIG. 12 is a diagram of the radial blade in FIG. 10 showing a view taken along Y-Y.

The blades 19 that forms the main pathway 26 have blade shapes that radiate at substantially the same angles with respect to the axial center 24 of the rotating shaft 13 at the main inlet 21, as shown in FIG. 12, and the blade shape is such that a center line XL thereof grows away from the rotating shaft 13 in a parabolic manner toward the outlet of the radial turbine wheel 15. This turning point is located near the joining portion 34.

The branching pathway wall 44 that forms the sub-pathway 32 is provided at a position extended toward the hub from the blade 19 positioned at the joining portion 34 in order to receive centrifugal forces at a main inlet portion, which is a portion of the blade 19 on a main-inlet 21 side, and the back plates 46.

Note that, when stresses that act on the branching pathway wall 44 of the blade 19 due to the centrifugal forces are sufficiently low, the angle of the main inlet portion of the blade 19 may be different from the angle of the branching pathway wall 44.

Figure 11:
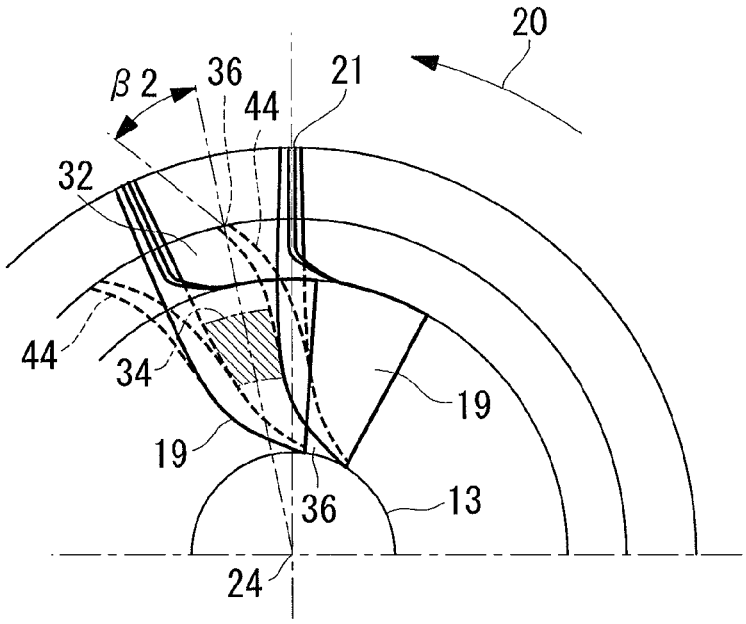
FIG. 11 is a front view of a radial blade in FIG. 10 viewed in the axial direction.

As shown in FIG. 11, the shape (blade shape) of the branching pathway wall 44 that forms the sub-inlet 36 is such that, in the plane orthogonal to the axial line of the rotating shaft 13, the center line of the branching pathway wall 44 is inclined toward the downstream side in the rotation direction 20 at the angle (predetermined angle) $\beta 2$ with respect to the radial direction. Note that it is preferable that the angle $\beta 2$ be 10° or greater.

By doing so, as with the sub-inlet 29 in the first embodiment, the magnitude of the swirling flow velocity component Cu2 of the fluid that flows in with the relative flow velocity along the blade surface inclined at the angle $\beta 2$ near the sub-inlet 36 becomes smaller than that of the circumferential velocity U2 of the radial turbine wheel 15 at that position. In other words, the magnitudes of the swirling flow velocity component Cu2 and that of the circumferential velocity U2 are different.

Therefore, the radius R2 of the sub-inlet 36 is set as follows. There is the relationship $g*H2 \approx Cu2*U2$ with regard to the inlet pressure P2 and the head H2 at the sub-inlet 36. Assuming that the rotational speed of the radial turbine wheel 15 is N (rpm), the radius R2 of the sub-inlet 36 is set to be a value close to $R2 \approx U2/2 \cdot \pi/(N/60)$.

This is more precisely expressed as $g*H2=Cu2*U2-Cud*Ud$, and, because the setting at the design point is generally $Cud \approx 0$, consequently, the radius R2 of the sub-inlet 36 is set by using the above-described relationship.

When the sub-inlet 36 is formed so that, in the plane orthogonal to the axial line of the rotating shaft 13, the center line of the branching pathway wall 44 is substantially parallel to the radial direction, radius R2' of the position where the sub-inlet 36 is provided is set in a similar manner as the radius R1 of the main inlet 21. Specifically, there is the relationship $g*H2 \approx U2'^2$ ($\approx Cu2' \cdot U2'$) with regard to the inlet pressure P2' and the head H2'. Assuming that the rotational speed of the radial turbine wheel 15 is N (rpm), the radius R2' is set to be a value close to $R2' \approx U2'/2 \cdot \pi/(N/60)$.

When setting the head H2 and the head H2' to be the same in these relationships, this can be achieved by, for example, using a constant $\alpha$ that is equal to 1 or greater so that $Cu2=Cu2'/\alpha$ and $U2=U2'*\alpha$. At this time, if the rotational speed is constant, the relationship between the radius R2 and the radius R2' is expressed as $R2=R2'*\alpha$.

Therefore, when the heads H are the same, the radius R2 can be made larger than the radius R2', as shown in FIG. 10.

Because it is possible to increase the radius R2 where the sub-inlet 36 is provided in this way, the position of the inflow sub-channel 40 can be set at a position separated from the rotating shaft 13. In other words, the height of a space 54 from the bottom end of the inflow sub-channel 40 to the rotating shaft 13 can be increased.

Although a bearing, a seal structure, and so forth of the radial turbine wheel 15 are provided in the surroundings of the rotating shaft 13, because the height of the space 54 can be increased, it is possible to ensure sufficient room for providing the bearing, the seal structure, and so forth.

In other words, the range of the head H2 with which the inflow sub-channel 40 can be provided so as not to interfere with the bearing, the seal structure, and so forth can be increased.

The main pathway 26 and the sub-pathway 32 are formed so that the height of the blade 19 in the main pathway 26 and the height of the branching pathway wall 44 in the sub-pathway 32 both increase as they approach the turbine wheel outlet, and a flow 48 of the low-boiling-point medium flowing in the main pathway 26 and a flow 50 of the low-boiling-point medium flowing in the sub-pathway 32 progressively decrease in pressures toward the outlet of the radial turbine wheel 15 while increasing in the flow-volume capacity.

In FIG. 10, isobars for the fluids that pass inside the radial turbine wheel 15 are indicated by one-dot-chain lines.

The radius R2 is set so that the pressure of the fluid supplied from the sub-inlet 36 and reaching the joining portion 34 becomes substantially the same as the pressure of the fluid that passes the joining portion 34 of the main pathway 26.

The casing 11 is provided with a casing wall 52 between the main inlet 21 and the sub-inlet 36, wherein one face thereof forms a pathway wall of the inlet flow channel 38 and the other face is adjusted so that a gap formed with respect to the back plate 46 becomes small.

The operation of the thus-configured radial turbine 100 according to this embodiment will be described below.

The low-boiling-point medium having the pressure P1 supplied from the binary cycle 7A passes through the inlet flow channel 25 from the main inflow channel 23, the flow volume and flow velocity thereof are adjusted by the nozzles 27, and the low-boiling-point medium is supplied to the main pathway 26 from the main inlet 21 at a flow volume G1. At this time, the pressure of the low-boiling-point medium supplied to the radial turbine wheel 15 is PN1. This low-boiling-point medium having the pressure PN1 flows out from the radial turbine wheel 15, while continuously decreasing in pressure until reaching the outlet pressure Pd of the radial turbine wheel 15, thus generating rotational motive power at the rotating shaft 13 to which the radial turbine wheel 15 is attached.

At this time, the low-boiling-point medium having the pressure P2 supplied from the binary cycle 7B passes through the inlet flow channel 38 from the inflow sub-channel 40, the flow volume and flow velocity thereof are adjusted by the nozzles 42, and the low-boiling-point medium is supplied to the sub-pathway 32 from the sub-inlet 36 at the flow volume G2. At this time, the pressure PN2 of the low-boiling-point medium supplied to the sub-pathway 32 from the sub-inlet 36 is decreased while the low-boiling-point medium flows in the sub-pathway 32 to be substantially equal to the pressure at the joining portion 34 in the main pathway 26.

Because the casing wall 52 that is adjusted for a gap so that the clearance between the main pathway 26 and the back plate 46 is reduced is provided between the main inlet 21 and the sub-inlet 36, even if the low-boiling-point media whose pressures, namely, the pressure PN1 and the pressure PN2, are different at the wheel inlet are used, it is possible to reduce leakage by suppressing leaking of the low-boiling-point medium having greater pressure from the main inlet 21 toward the sub-inlet 36.

At the joining portion 34, the low-boiling-point medium having the flow volume G2 that has flowed in from the sub-inlet 36 is mixed with the low-boiling-point medium having the flow volume G1 supplied from the main inlet 21. Because the main pathway 26 and the sub-pathway 32 are continuously formed by the blade 19 and the branching pathway wall 44, the fluids passing through these pathways can be smoothly mixed.

The mixed low-boiling-point medium flows out from the radial turbine wheel 15. The low-boiling-point medium having a combined flow volume of the flow volume G1 and the flow volume G2 generates rotational motive power at the rotating shaft 13 via the radial turbine wheel 15.

The generator 9 generates electric power by means of the rotating shaft 13 that is rotationally driven.

In this way, by supplying the low-boiling-point media having different pressures to the main inlet 21 and the sub-inlet 36 of the radial turbine wheel 15 from the binary cycles 7A and 7B, respectively, rotational motive power can be extracted by means of a single radial turbine wheel 15.

By doing so, the number of parts in the radial turbine 100 according to this embodiment can be reduced as compared with a plurality of expansion turbines or an expansion turbine provided with a plurality of radial turbine wheels, and thus, the manufacturing cost thereof can be reduced.

Note that, although a shroud is not provided in the radial turbine wheel 15 in this embodiment, a shroud may be attached thereto as needed.

By doing so, it is possible to reduce a leakage loss of the low-boiling-point medium in the main pathway 26, and thus, it is possible to increase the turbine efficiency.

Although a case in which the present invention is employed in the binary power generation system 3 having the two binary cycles 7A and 7B has been described in this embodiment, the usage of the expansion turbine 1 is not limited thereto.

For example, as shown in FIG. 8, the present invention can also be employed in the binary power generation system 3 having one binary cycle 7C.

In addition, the expansion turbine 1 may be employed in the plant system 2 shown in FIG. 9. The plant system 2 includes various types of industrial plant, and the present invention may be employed in, for example, a mixing step in processes involved in separation and mixing at a chemical plant.

Note that the present invention is not limited to the individual embodiments described above, and the various modifications may be incorporated within a range that does not depart from the scope of the present invention.

REFERENCE SIGNS LIST

1 expansion turbine
13 rotating shaft
15 radial turbine wheel
19 blade
21 main inlet
26 main pathway
29 sub-inlet
36 sub-inlet
44 branching pathway wall
100 radial turbine

The invention claimed is:

1. A radial turbine comprising:

a turbine wheel that is provided with a main pathway in which a blade height progressively increases while curving toward an axial direction from a radial direction, that converts swirling flow energy from a swirling fluid that flows into the main pathway from a main inlet positioned on an outer circumferential side and having a flow in the radial direction as the main component thereof into rotational motive power, and that expels the flow, whose energy has been released, in the axial direction, wherein a sub-inlet into which flows a fluid whose pressure differs from pressure of the fluid supplied from the main inlet is formed on a shroud side of the turbine wheel at a position separated from the main inlet in the radial direction and the axial direction; and a blade shape that forms the sub-inlet is such that, in a plane orthogonal to the axial line of the turbine wheel, a center line of the blade is inclined at a predetermined angle toward the rotation direction with respect to the radial direction.

2. A radial turbine according to claim 1, wherein, in a cylindrical surface centered on the axial center of the turbine wheel, a line tangent to a leading edge of the blade that forms the sub-inlet is inclined so as to be opened from the axial center on the tip side of the blade.

3. A radial turbine according to claim 2, wherein the predetermined angle is 10° or greater.

4. A radial turbine according to claim 1, wherein the predetermined angle is 10° or greater.

5. A radial turbine comprising:

a turbine wheel that is provided with a main pathway in which a blade height progressively increases while curving toward an axial direction from a radial direction, that converts swirling flow energy from a swirling fluid that flows into the main pathway from a main inlet positioned on an outer circumferential side and having a flow in the radial direction as the main component thereof into rotational motive power and, that expels the flow, whose energy has been released, in the axial direction, wherein the turbine wheel is provided with a sub-pathway at a position radially inward of the main inlet, which branches from a hub surface of the main pathway and extends toward a back-face side of the main pathway;

a sub-inlet into which a fluid whose pressure differs from the pressure of the fluid supplied from the main inlet is supplied is formed at an outer circumferential end of the sub-pathway at a radial position different from that of the main inlet; and a blade shape that forms the sub-inlet is such that, in a plane orthogonal to the axial line of the turbine wheel, a center line of the blade is inclined at a predetermined angle toward the rotation direction with respect to the radial direction.

6. A radial turbine according to claim 5, wherein the predetermined angle is 10° or greater.

* * * * *